US005251389A

United States Patent [19]

Bessey

[11] Patent Number: 5,251,389

[45] Date of Patent: Oct. 12, 1993

[54] BRACE FOR MAINTAINING RELATIVE ARM-DIPPER ANGLE

[75] Inventor: Jay C. Bessey, Greenfield, Wis.

[73] Assignee: Harnischfeger Corporation, Milwaukee, Wis.

[21] Appl. No.: 909,698

[22] Filed: Jul. 7, 1992

[51] Int. Cl.[5] ..... E02F 3/36

[52] U.S. Cl. ..... 37/398; 37/379; 403/44; 403/46; 414/711; 414/723

[58] Field of Search ..... 37/103, 115, 116, 135; 414/723, 684, 711; 403/43–48

[56] References Cited

U.S. PATENT DOCUMENTS

| | | | |
|---|---|---|---|
| 260,366 | 7/1882 | Burr | 403/46 X |
| 868,595 | 10/1907 | Channon | 37/135 |
| 1,550,938 | 8/1925 | Walsh | 414/723 X |
| 1,883,915 | 10/1932 | Holcomb | 414/723 |
| 2,352,585 | 6/1944 | Camburn | 403/46 |
| 2,420,363 | 5/1947 | Espenas | 403/43 |
| 2,446,624 | 10/1948 | Allison | 403/44 X |
| 2,845,288 | 7/1958 | Cierpik | 403/46 |

FOREIGN PATENT DOCUMENTS

| | | | |
|---|---|---|---|
| 604911 | 4/1978 | U.S.S.R. | 414/723 |

*Primary Examiner*—Randolph A. Reese
*Assistant Examiner*—Arlen L. Olsen
*Attorney, Agent, or Firm*—Jansson & Shupe

[57] ABSTRACT

The invention is an improvement in a machine such as a surface mining "shovel" having an arm, a bucket-like digging dipper and a brace. The latter is used to maintain a selected "rake angle" between the arm and the dipper. The brace has first and second end lugs and extends between the arm and the dipper. The improvement comprises a tube-like collar interposed between and connecting the lugs. At least the first end lug is positionally adjustable with respect to the collar so that the "rake angle" between the arm and the dipper may be readily selected. In a highly preferred embodiment, each end lug is threaded to an opposite end of the collar and better "vernier" adjustment of the rake angle results.

9 Claims, 4 Drawing Sheets

BRACE FOR MAINTAINING RELATIVE ARM-DIPPER ANGLE

FIELD OF THE INVENTION

This invention relates to mobile machinery and, more particularly, to surface mining machinery.

BACKGROUND OF THE INVENTION

Minerals removed from the earth, e.g., coal, iron ore and the like, are recovered in two fundamental ways, namely, by underground mining and by surface mining. Surface mining operations use digging machines of a type sometimes referred to as "steam shovels" by persons outside the industry. Of course, such steam-operated machines have not been manufactured for some time.

Surface mining machines are equipped with what are known in the industry as buckets or dippers. In a bucket-equipped machine, the bucket teeth point toward the machine while in a dipper-equipped machine, they point away from the machine. And a dipper has a bottom dump door opened to let the recovered mineral fall from the dipper by gravity. Both buckets and dippers are used as "scoops" to remove the mineral and, sometimes, earth overburden covering the mineral. Such buckets and dippers have a carrying capacity usually measured in cubic yards.

With dipper-equipped machines, it has been known for some time that the ability of the machine to efficiently remove mineral without overloading the machine relates in large part to the relative included angle (sometimes called a "rake" or "attack" angle) measured between the dipper-supporting "handle" or arm and an upward-projected line along the front face of the dipper. To put it another way, adjustment of such angle controls the angle at which the teeth "bite into" the material being removed.

Control of such angle is not a trivial concern, especially on larger machines, and needs to be varied with variations in the material being removed and/or with the size of the dipper used on a particular machine. As an example, a 50° rake angle may be acceptable for soft material or overburden while a 48° rake angle may be better for harder, more dense material.

And for a particular dipper capacity, adjustment of the rake angle can help avoid overloading the machine. This possibility is readily apparent when one considers that coal weighs about 1,500 lbs./cu. yd. while iron ore (which is more than twice as dense) weighs about 3,500 lbs./cu. yd.

In smaller digging machines, selection of the rake angle is not as critical, even with changes in material being mined. However, as the dipper capacity increased with machine size, the rake angle becomes increasingly critical and more sensitive to differing mining parameters. And an experienced operator can detect a difference as small as one-half degree in rake angle.

Conventionally, the rake angle is maintained by a pitch brace extending between the arm and the dipper with the brace, arm and dipper forming a triangle. Selection of the length of the pitch brace (typically a rigid length of steel with a pin "eye" at each end) is sufficiently complex to have been determined using a computer program. However, changes in field requirements sometimes necessitate that the length of the pitch brace be changed. This creates a practical problem.

It is extremely uncommon for a mining crew to have more than the one pitch brace on hand. Mining machines are usually used in remote sites. Replacement parts are difficult to deliver and, because of their size and weight, are even more difficult to install. In other words, replacement of a conventional pitch brace with one of a different length is very time consuming and difficult. There is little margin for error—the length of any needed replacement must be estimated very accurately.

And a mistake in length of a replacement brace is not the only aspect of the problem. A large dipper-type mining machine weighs about 2.5 million pounds and costs several million dollars. When a pitch brace needs to be replaced, the machine is necessarily idled. Such "downtime" is anathema to a mining company.

Until the invention, pitch braces were designed and available only in whole-inch increments. On the other hand, it is not unusual to need an adjustment in brace length on the order of a fraction of an inch to obtain, say, a one-half degree change in rake angle. A more efficient and more precise means of changing the pitch brace length is clearly needed.

As will become apparent, the invention resolves some of these difficulties in unique and imaginative ways.

OBJECTS OF THE INVENTION

It is an object of the invention to provide an improved pitch brace overcoming some of the problems and shortcomings of the prior art.

Another object of the invention is to provide an improved pitch brace which reduces machine downtime.

Another object of the invention is to provide an improved pitch brace permitting "finer" adjustment of the arm-dipper angle.

Another object of the invention is to provide an improved pitch brace which may be considered "universal," i.e., adaptable for use in a variety of mining situations.

How these and other objects are accomplished will become apparent from the following descriptions and the drawing.

SUMMARY OF THE INVENTION

The invention is an improvement in a "shovel type" mining machine or excavator used to remove, e.g., minerals such as iron ore from the earth. The machine has an outward-extending arm, a digging dipper mounted at the end of the arm and a brace having first and second end lugs. The brace extends between the arm and the dipper and maintains a selected angle between them.

The improved brace includes a tube-like collar interposed between and connecting the end lugs, each of which has an aperture or hole for "pinning" the brace to the machine. At the least, the first end lug is positionally adjustable with respect to the collar whereby the angle between the arm and the dipper may be readily selected. The ability to adjust the brace length thereby allows the arm-dipper angle to be adjusted with relatively little difficulty.

Additionally, at least the first end lug has a shaft, preferably threaded with an Acme thread, which connects to the collar. The shaft has at least one groove along at least a portion of its length. The collar also has a least one cap screw (or other type of bolt-like member) adjustable to extend into the groove. Such screw-groove engagement prevents relative movement of the first end lug and the collar with respect to one another and maintains a constant, selected arm-dipper angle.

The collar and at least the first end lug each include a means for engaging a tool to rotate the collar and the first end lug relative to one another. Such tool-engaging means could be a wrench "hex" or the like. However, in the preferred embodiment, rotation of the collar and the first end lug relative to one another is by a pocket to which a spanner wrench may be applied.

A highly preferred three-piece embodiment incorporates the collar and a pair end lugs, each of which is threaded to the collar. In such embodiment, each end lug has at least one groove along at least a portion of its length for receiving a collar-lug securing screw. And like the previously-described embodiment, the brace as means for engaging a tool for rotating the collar and each end lug relative to one another.

DETAILED DESCRIPTION OF PREFERRED EMBODIMENTS

Figure 1:
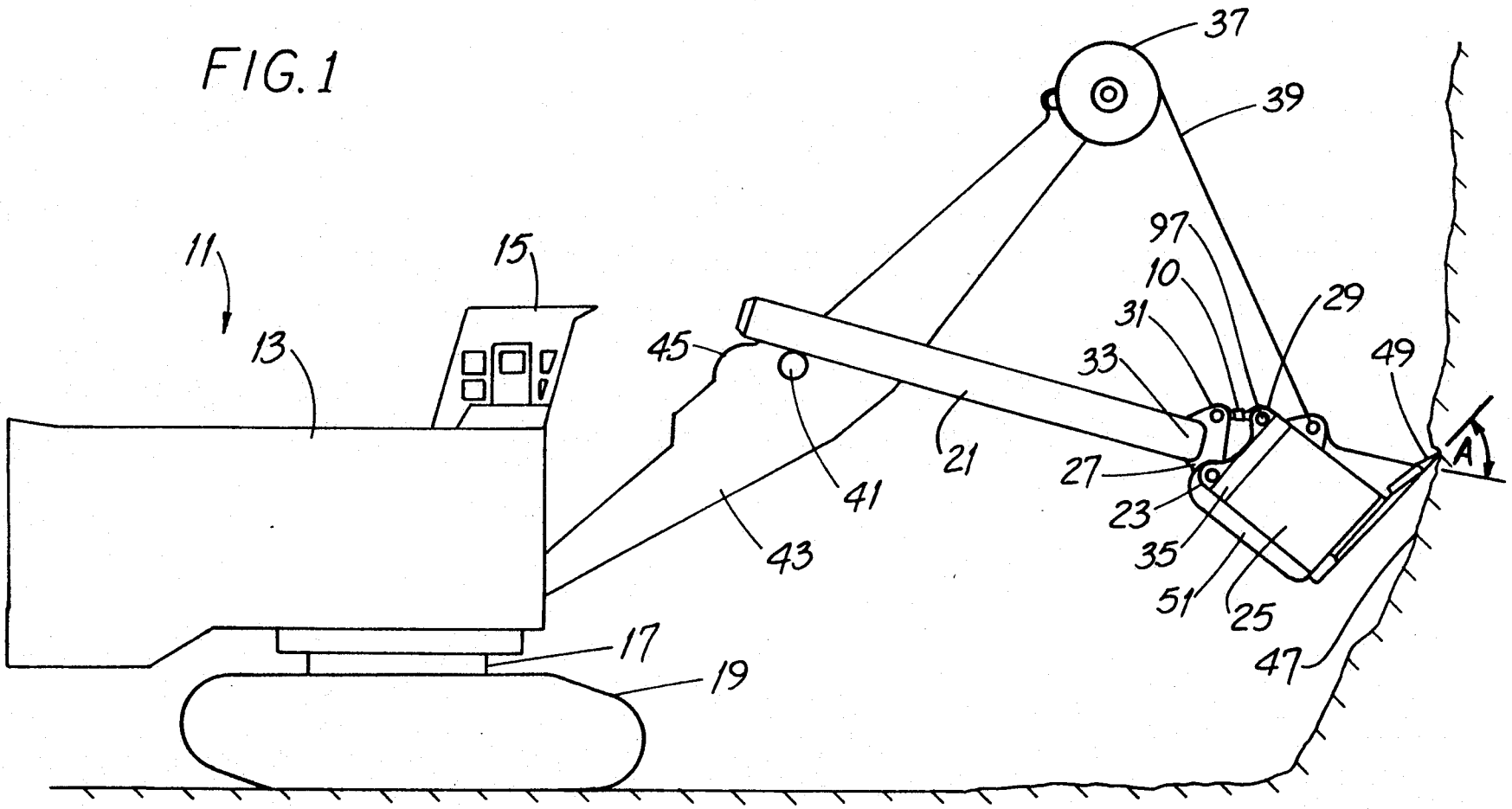
FIG. 1 is a simplified side elevation view of a representative shovel-type mining machine.

Before describing the inventive brace 10, it will be helpful to appreciate some aspects of a shovel-type surface mining machine 11. Referring to FIG. 1, such machine 11 has a machinery house 13, an operator's station 15, a pivot platform 17 and a pair of crawler treads 19, one at either side of the machine 11. The machine 11 also has a dipper support arm 21, sometimes referred to as a "handle." The clevis-like lower eye 23 of a dipper 25 is attached to the arm 21 at a lower arm coupling point 27. The dipper upper eye 29 is attached to the upper arm coupling point 31 by the inventive brace 10. As is apparent from FIG. 1, the arm end 33, the brace 10 and the dipper rear panel 35 generally define a triangle.

It is to be appreciated that FIG. 1 shows only one side of the dipper 25 and arm 21. In fact, the dipper 25 and arm 21 are connected at both the left and right sides of the machine 11 in "mirror image" fashion and there are two braces 10 extending between the arm 21 and the dipper 25.

The machine 11 is capable of three types of motion, namely, "hoist," "crowd" and "swing." The boom sheave 37 is attached to the dipper 25 by a cable 39 and when the sheave 37 is rotated, the arm 21 pivots about the joint 41 to raise and lower the dipper 25. The arm 21 and joint 41 can also be powered down and up the boom 43 by a rack-and-pinion mechanism 45 (while using coordinated hoist motion) and the dipper 25 thereby moves away from the face 47 or toward it, the latter known as the "crowd" motion. After the dipper teeth 49 dig into the material and the dipper 25 is filled, the operator swings the machine 11, thereby moving the dipper 25 to the side for emptying to a truck, rail car, spoil pile or the like. Emptying is by opening a lower door 51 which forms the bottom of the dipper 25.

Figure 2:
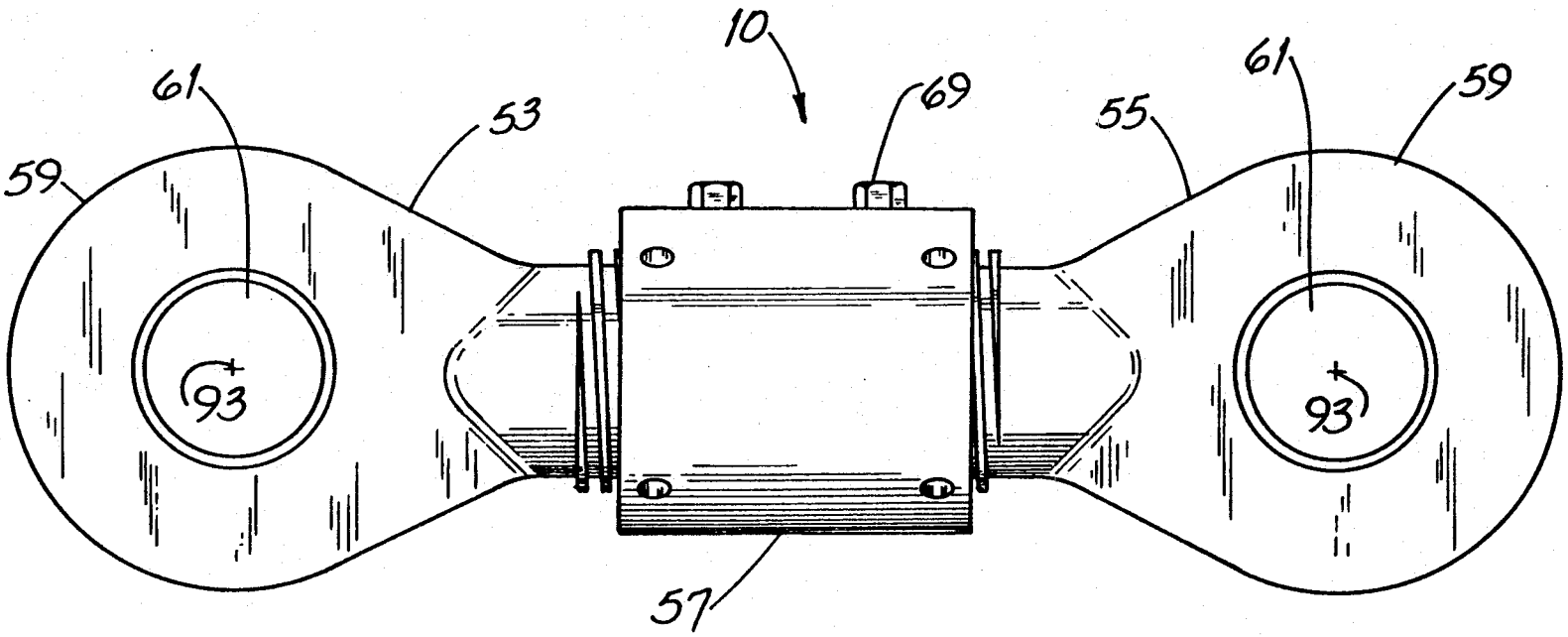
FIG. 2 is a side elevation view of the inventive pitch brace.

The inventive pitch brace 10 will now be described. Referring to FIG. 2, the preferred adjustable pitch brace 10 includes first and second end lugs, 53 and 55, respectively, and a tube-like "inside-threaded" collar 57 connecting the lugs 53, 55. The lugs 53, 55 are interchangeable and near its distal end 59, each lug 53, 55 has a hole or aperture 61 for pinning the lug 53, 55 to the arm 21 or dipper 25, as the case may be.

Figure 4:
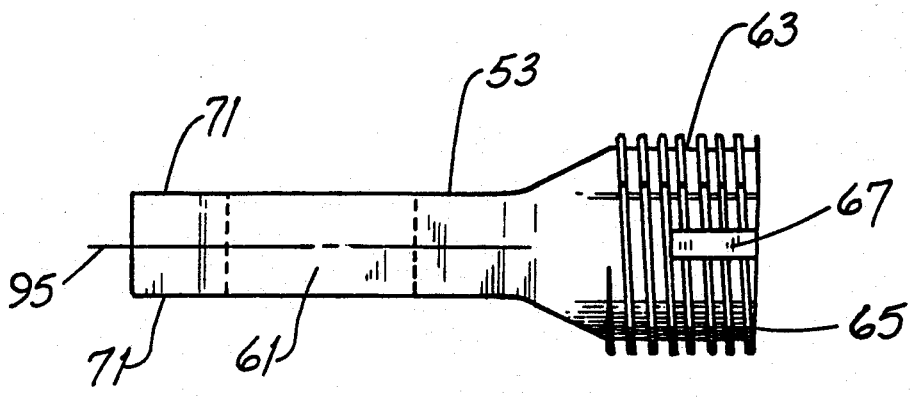
FIG. 4 is a top plan view of the lug of FIG. 3 taken along the viewing plane 3—3 thereof.
Figure 3:
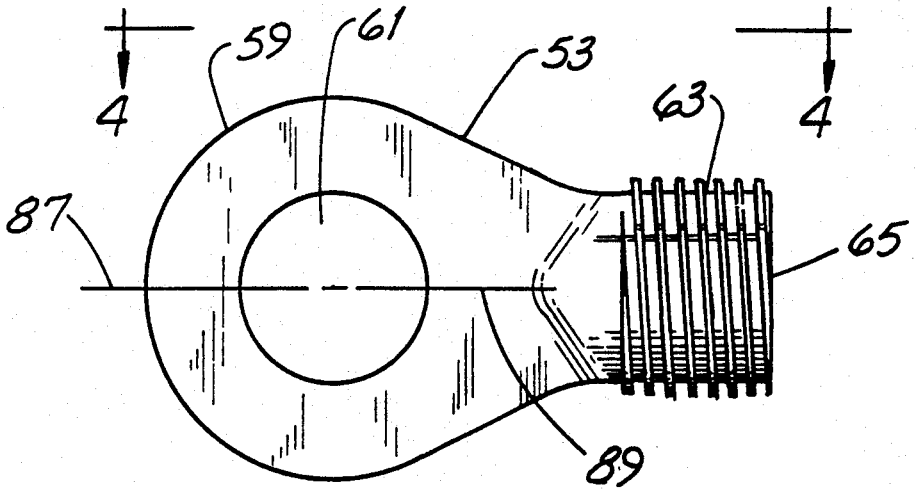
FIG. 3 is a side elevation view of an end lug component of the brace of FIG. 2.

Referring additionally to FIGS. 3 and 4, the shaft 63 at the proximal end 65 of each lug 53, 55 is threaded to engage the collar 57 as described in more detail below. Each shaft 63 has at least one groove 67 along at least a portion of its length for receiving a collar-lug securing screw 69. In a highly preferred embodiment, there are two grooves 67 spaced about 180° apart about the circumference of the shaft 63. Each lug distal end 59 has generally flat, parallel sides 71. The lug thickness between the sides 71 is cooperatively selected with the spacing between the protrusions forming the upper eye 29 and the upper arm coupling point 31 so that a lug 53, 55 can be inserted between the protrusions with slight clearance.

Figure 5:
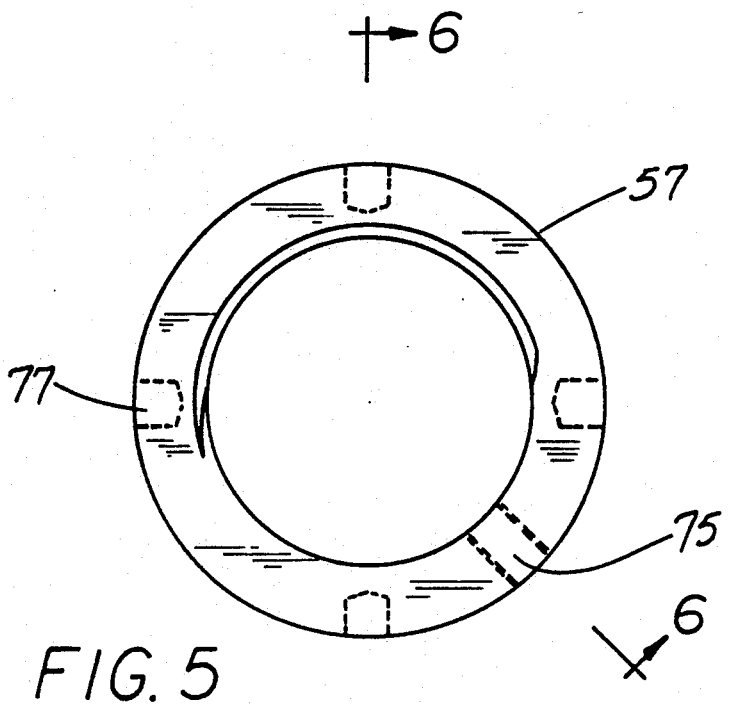
FIG. 5 is an end view of the collar component of the brace of FIG. 2.
Figure 6:
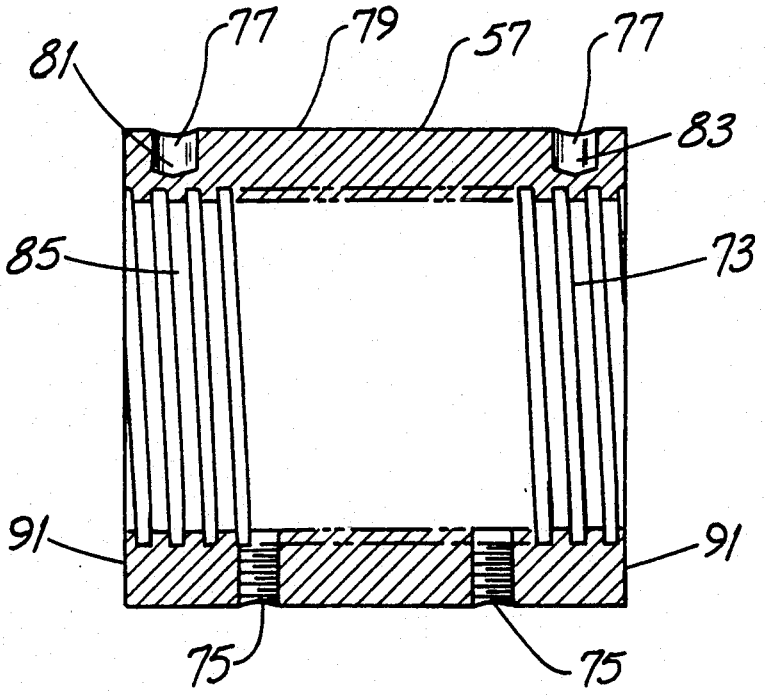
FIG. 6 is a cross-sectional view of the collar of FIG. 5 taken along the section 6—6 thereof.

Referring to FIGS. 5 and 6, the collar 57 is a tube-like member of substantially uniform diameter and with a threaded inside wall 73. A cap screw 69 is received through each of two radial holes 75 in the collar 57 and such screws 69 are selected to have a length so that when fully "bottomed," they extend into an aligned groove 67 in a lug 53, 55. A screw 69 and a groove 67 thereby cooperate to secure the relative rotational position of the collar 57 and a lug 53, 55 with respect to one another.

The collar 57 also includes a plurality of "pockets" 77 drilled or otherwise formed radially into (but preferably not through) the outer wall 79 of the collar 57. The depth of the pockets 77 is selected to permit engagement by a tool, such as a spanner wrench, used to turn an end lug 53, 55 and the collar 57 relative to one another. In a highly preferred embodiment, the collar 57 has two sets 81, 83 of four pockets 77 each with the pockets 77 of each set 81 83 being spaced about 90° about the outer circumference of the collar 57.

In a highly preferred embodiment, the threads 85 of the collar inside wall 73 and on the shaft 63 of each lug 53, 55 are Acme threads, a known thread style characterized by the substantially square cross-sectional shape of a thread 85. Acme threads are preferred for at least two reasons. They are very difficult to cross-thread and their large cross-sectional area (compared to a conventional triangular "sharp-edged" thread) provides great strength.

In the exemplary embodiment, the thread pitch (the distance between corresponding points on adjacent threads 85) is about one-half inch. Since each lug 53, 55 is symmetrical about a plane 87 through the lug centerline 89 and perpendicular to the sides 71 and since there are two 180°-spaced grooves 67, lug rotation of one-half turn provides an incremental brace length adjustment of about one-quarter inch. Such incremental adjustment is sufficiently "fine" for a large mining machine 11. To assemble the brace 10, the shaft 63 of each end lug 53, 55 is screwed into an end 91 of the collar 57. Preferably, the shafts 63 are screwed into the collar 57 to approximately the same depth and to that depth which provides the desired spacing between the centerpoints 93 of the apertures 61. Each lug 53, 55 is rotated slightly until a lug groove 67 is aligned with a cap screw 69 which is then turned in to engage the groove 67. And since each groove 67 is coincident with a plane 95 equidistant from and parallel to the sides 71 of a lug 53, 55, respective sides 71 (left or right) of the lugs 53, 55 will then be coplanar.

The brace 10 for an exemplary mining machine 11 is more than four feet long and weighs in excess of 1,400 lbs. To adjust the length of the brace 10 (and, therefore, the rake angle "A"), the pin is removed from one lug 53, 55, thereby disconnecting such lug 53, 55 from the arm 21 or dipper 25. A spanner wrench is used to engage the pockets 77 in the collar 57 and a "pry bar" is inserted through the aperture 61 so that the collar 57 and lug 53, 55 can be rotated relative to one another. As described above, manipulation of the collar 57 and a lug 53, 55 should be in a way that the proximal ends 65 of the lugs 53, 55 are threaded into the collar 57 to approximately the same depth. Once adjustment is made, the lug 53, 55 is re-pinned.

While the principles of this invention have been described in connection with specific embodiments, it should be understood clearly that these descriptions are made only by way of example and are not intended to limit the scope of the invention. Other configurations are possible without departing from the spirit of the invention.

For example, in an "inside out" version of the brace 10, the proximal ends 65 of the lugs 53, 55 can be female ends with interior threads 85 and the collar 57 an exteriorly threaded male piece with grooves 67. In this arrangement, each lug proximal end 65 would have one or two cap screws 69 for securing relative lug-collar position. And each lug shaft 63 need not have the same type or pitch of thread although disparate threads would likely make manufacture more difficult.

As another example, the collar 57 and first end lug 53 can be fabricated as a single piece with length adjustment by rotating the second lug 55 and the collar/first lug combination with respect to one another.

I claim:

1. In a machine having an arm, a digging dipper and a brace extending between the arm and the dipper for maintaining a selected angle therebetween, the brace having first and second end lugs, the improvement comprising:

a collar interposed between and connecting the lugs;

the first end lug has a threaded shaft connecting to the collar and is positionally adjustable with respect to the collar;

the threaded shaft has at least one groove along at least a portion of its length; and, the collar has at least one screw adjustable to extend into the groove thereby preventing relative movement of the first end lug and the collar with respect to one another.

2. The brace of claim 1 wherein the collar includes tool-engaging means for rotating the collar and the first end lug relative to one another.

3. The brace of claim 2 wherein the tool-engaging means includes at least one pocket in the collar for applying a spanner wrench thereto.

4. The brace of claim 1 wherein each end lug has a pin aperture and a threaded shaft connecting to the collar.

5. The brace of claim 4 wherein each end lug has at least one groove along at least a portion of its length for receiving a collar-lug securing screw.

6. The brace of claim 5 including tool-engaging means for rotating the collar and the end lugs relative to one another.

7. In a machine having an arm, a digging dipper and a brace extending between the arm and the dipper for maintaining a selected angle therebetween, the brace having first and second end lugs, the improvement wherein:

the brace has a collar interposed between and connecting the lugs;

the collar has tool-engaging means for rotating the collar and either end lug relative to one another;

each lug includes a threaded shaft connecting to the collar and an aperture for inserting a pin therethrough; and, each lug has at least one groove along at least a portion of its length for receiving a collar-lug securing screw, whereby the angle between the arm and the dipper may be readily selected.

8. The brace of claim 7 wherein the tool-engaging means includes a pair of circumferentially-spaced pockets formed in the collar, whereby a spanner wrench may be coupled to the collar at either of two locations.

9. A brace for maintaining a selected angle between the arm and the digging dipper of a mining machine and including:

a generally cylindrical collar;

a pair of end lugs coupled to the collar, each end lug having a groove engaged by a separate position-retaining screw extending through the collar;

the collar including separate tool-engaging means adjacent to each end lug for coupling a spanner wrench to the collar, whereby, by disengaging a screw form a lug groove to free an end lug for rotation, the collar or that freed end lug may be relatively rotated one to the other without disengaging the screw from the groove of the other end lug.

* * * * *